US011520293B2

(12) United States Patent
Colpo

(10) Patent No.: US 11,520,293 B2
(45) Date of Patent: Dec. 6, 2022

(54) REGULATOR DEVICE FOR A WATCH MOVEMENT

(71) Applicant: ROLEX SA, Geneva (CH)

(72) Inventor: Fabiano Colpo, Lausanne (CH)

(73) Assignee: ROLEX SA, Geneva (CH)

( * ) Notice: Subject to any disclaimer, the term of this patent is extended or adjusted under 35 U.S.C. 154(b) by 455 days.

(21) Appl. No.: 16/598,311

(22) Filed: Oct. 10, 2019

(65) Prior Publication Data

US 2020/0117141 A1 Apr. 16, 2020

(51) Int. Cl.
*G04B 15/08* (2006.01)
*G04B 17/06* (2006.01)

(52) U.S. Cl.
CPC ..... *G04B 17/063* (2013.01); *G04B 15/08* (2013.01)

(58) Field of Classification Search
CPC ..... G04B 15/08; G04B 17/06; G04B 17/063
See application file for complete search history.

(56) References Cited

U.S. PATENT DOCUMENTS 6,846,104 B2 * 1/2005 Geyer ..... G04B 17/285 368/146
6,863,434 B2 * 3/2005 Mojon ..... G04B 17/285 368/127
9,016,933 B2 4/2015 Cettour-Baron et al.
9,164,486 B2 * 10/2015 Kawauchiya ..... G04B 17/285
2003/0112709 A1 * 6/2003 Mojon ..... G04B 15/10 368/127
2004/0062149 A1 * 4/2004 Geyer ..... G04B 17/285 368/127
2011/0216629 A1 9/2011 Zaugg et al.
2013/0028056 A1 1/2013 Cettour-Baron et al.
2013/0194900 A1 * 8/2013 Capt ..... G04B 15/06 74/1.5
2015/0063083 A1 * 3/2015 Kawauchiya ..... G04B 17/285 368/127

(Continued)

FOREIGN PATENT DOCUMENTS

CH 702 313 B1 6/2011
EP 2 363 763 A2 9/2011

(Continued)

OTHER PUBLICATIONS

European Search Report and Written Opinion dated Mar. 28, 2019 issued in counterpart application No. EP18200041; w/ English machine translation (total 18 pages).

*Primary Examiner* — Sean Kayes
(74) *Attorney, Agent, or Firm* — WHDA, LLP

(57) ABSTRACT

A regulator device (200) for a watch movement has (a) an inertial element (11) of a resonator (10) of inertia I, pivoted about a first axis (A1) and inscribed within a cylinder of diameter D centered on the first axis; (b) an escapement mobile (30) of inertia I3, pivoted about a second axis (A3) and inscribed within a cylinder of diameter D3 centered on the second axis; and (c) a blocking member having (i) a first blocking lever mobile (20*a*) of inertia I2*a*, pivoted about a third axis (A2*a*) and inscribed within a cylinder of diameter D2*a* centered on the third axis; and (ii) a second blocking lever mobile (20*b*) of inertia I2*b*, pivoted about a fourth axis (A2*b*), inscribed within a cylinder of diameter D2*b* centered on the fourth axis, the axes (A3, A2*a*, A2*b*) contained within a cylinder centered on the first axis (A1) and of diameter D'<D.

21 Claims, 4 Drawing Sheets

(56) References Cited

U.S. PATENT DOCUMENTS

| | | | |
|---|---|---|---|
| 2019/0243308 | A1 | 8/2019 | Winkler et al. |
| 2019/0271945 | A1 | 9/2019 | Winkler et al. |
| 2019/0278227 | A1 | 9/2019 | Winkler et al. |

FOREIGN PATENT DOCUMENTS

| | | | |
|---|---|---|---|
| EP | 2 551 732 | A1 | 1/2013 |
| EP | 2 863 272 | A1 | 4/2015 |
| EP | 3 327 515 | A1 | 5/2018 |

* cited by examiner

REGULATOR DEVICE FOR A WATCH MOVEMENT

This application claims priority of European patent application No. EP18200041.4 filed Oct. 12, 2018, the content of which is hereby incorporated by reference herein in its entirety.

The invention relates to a regulator device for a watch movement. The invention also relates to a watch module comprising a suchlike device. The invention further relates to a watch movement comprising a suchlike device or module. The invention finally relates to a timepiece comprising a suchlike device or module or movement.

The majority of mechanical movements comprise a regulator including a resonator of the balance wheel and hairspring type and a Swiss lever escapement cooperating with the resonator. The balance wheel and hairspring constitute the time base of the movement. The escapement, on the other hand, performs two main functions, namely maintaining the oscillations of the resonator and counting these oscillations.

These components assure essential functions, and it is therefore necessary to design components in order to avoid any malfunctioning.

In the case of traditional regulator devices, an efficient balance wheel and hairspring is known to exhibit a maximized regulating power such as to present a high factor of quality, typically in the order of 320 in the horizontal position of the movement, while minimizing the energy necessary for maintaining its oscillations. On the other hand, it is acknowledged, for example as explained in the publication of 1969 by Pierre Chopard entitled "Influence of balance wheel geometry on the chronometric efficiency of the watch", published in the Proceedings of the International Conference on Chronometry, and in the book "Construction horlogère (Watch Design)" (PPUR, 2011), that balance wheels of large diameter and of low mass exhibit the best efficiency for a given inertia.

Furthermore, the resonator must be of an acceptable size, compatible with the dimensions of a movement of a watch, especially a wristwatch (for example, movements exhibiting diameters comprised between 20 mm and 35 mm). A resonator of the balance wheel and hairspring type typically comprises a balance wheel of which the diameter is comprised between 7 mm and 12 mm.

The aim of the invention is to make available a regulator device for a watch movement in order to improve the devices that are known from the prior art. In particular, the invention proposes a regulator device of which the function is optimized with regard to its reliability, chronometric accuracy and energy losses, and with regard to its compactness.

According to a first aspect of the invention, a regulator device according to the invention is defined by point 1 below.

1. A regulator device for a watch movement, comprising:
   - an inertial element of a resonator pivoted about a first axis A1, the inertial element being inscribed within a first cylinder having a diameter D centered on the first axis and the resonator having a first inertia I;
   - an escapement mobile comprising an escape wheel and pivoted about a second axis A3, the escapement mobile being inscribed within a second cylinder having a diameter D3 centered on the second axis and having a second inertia I3;
   - a blocking member comprising:

- a first blocking lever mobile comprising a first blocking lever element, the first blocking lever mobile being pivoted about a third axis A2*a*, inscribed within a third cylinder having a diameter D2*a* centered on the third axis and having a third inertia I2*a*; and
   - a second blocking lever mobile comprising a second blocking lever element, the second blocking lever mobile being pivoted about a fourth axis A2*b*, inscribed within a fourth cylinder having a diameter D2*b* centered on the fourth axis and having a fourth inertia I2*b*,
   - the first and second blocking lever mobiles being arranged in such a way as to cooperate, especially by gearing, with each other, the axes A3, A2*a*, A2*b* of the escapement mobile and of the first and second blocking lever mobiles being contained within a cylinder centered on the first axis A1 and having a diameter D', where D'<D, or D'≤0.9×D, or D'≤0.85×D.

Different embodiments of the device are defined by points 2 to 12 below.

2. The device according to point 1, wherein the regulator device is such that
   D2*a*<0.4×D, or D2*a*≤0.35×D, or D2*a*≤0.3×D, and/or
   D2*b*<0.35×D, or D2*a*≤0.3×D, or D2*a*≤0.25×D, and/or
   D3<0.4×D, or D3≤0.35×D, or D3≤0.3×D.
3. The device according to one of points 1 and 2, wherein the regulator device is such that
   D2*b*×I2*b*≤D2*a*×I2*a*.
4. The device according to one of points 1 to 3, wherein the regulator device is such that
   $D^5 \times f/I > 20 \cdot 10^{-2}\ m^3\ kg^{-1}\ s^{-1}$, where f is the frequency of the resonator, the frequency preferably being greater than or equal to 4 Hz.
5. The device according to one of points 1 to 4, wherein the regulator device is such that
   D2*b*<D2*a*; and/or
   D2*b*'<D3; and/or
   D2*a*'<D3,
   where:
   - D2*a*' is a diameter of a cylinder on which a blocking surface of the first blocking lever mobile rests, and
   - D2*b*' is a diameter of a cylinder on which a blocking surface of the second blocking lever mobile rests.
6. The device according to one of points 1 to 5, wherein the regulator device is such that
   7 mm≤D≤11 mm.
7. The device according to one of points 1 to 6, wherein the device comprises:
   - on the inertial element, respectively on the first blocking lever mobile, a tooth or a pin of which the flanks comprise a portion of cylinder having a profile of an involute of a circle, and
   - on the first blocking lever mobile, respectively on the inertial element, a fork of which the flanks comprise a portion of cylinder having a profile of an involute of a circle.
8. The device according to one of points 1 to 7, wherein the first blocking lever mobile, in particular the first blocking lever element, is made of silicon and/or comprises cutouts on its plate, and/or wherein the second blocking lever mobile, in particular the second blocking lever element, is made of silicon and/or comprises cutouts on its plate.
9. The device according to one of points 1 to 8, wherein the escape wheel comprises two or three or four teeth.

10. The device according to one of points 1 to 9, wherein the tooth or the pin, the first and second blocking lever elements and the escape wheel are arranged on the same level or in the same plane.
11. The device according to one of points 1 to 10, wherein it comprises a resonator of the balance wheel and hairspring type, the inertial element being a balance wheel.
12. The device according to one of points 1 to 11, wherein it comprises an intermediate mobile arranged between a going train of the movement and the escapement mobile, the intermediate mobile comprising a wheel configured to transmit to the blocking member a first effort during the pulse phases of the escapement and to transmit to the blocking member a second effort during the phases of disengagement of the escapement, the first effort being greater than the second effort.

According to the first aspect of the invention, a watch module according to the invention is defined by point 13 below.

13. A watch module comprising a device according to one of points 1 to 12, wherein the first and second blocking lever mobiles and the escapement mobile are pivoted between a first movement blank, especially a bridge, and a second movement blank, especially a bridge.

According to the first aspect of the invention, a watch movement according to the invention is defined by point 14 below.

14. A watch movement comprising a watch module according to point 13 and/or a device according to one of points 1 to 12.

According to the first aspect of the invention, a timepiece according to the invention is defined by point 15 below.

15. A timepiece, especially a wristwatch, comprising a watch movement according to point 14 and/or a watch module according to point 13 and/or a device according to one of points 1 to 12.

According to a second aspect of the invention, a device is defined by the following definitions.

1. A regulator device (200) for a watch movement (300), comprising:
   an inertial element (11) of a resonator (10) pivoted about a first axis (A1), the inertial element being inscribed within a first cylinder having a diameter D centered on the first axis and the resonator (10) having a first inertia I;
   an escapement mobile (30) comprising an escape wheel (3) and pivoted about a second axis (A3), the escapement wheel being inscribed within a second cylinder having a diameter D3 centered on the second axis and having a second inertia I3;
   a blocking member (2) comprising:
      a first blocking lever mobile (20*a*) comprising a first blocking lever element (2*a*), the first blocking lever mobile being pivoted about a third axis (A2*a*), inscribed within a third cylinder having a diameter D2*a* centered on the third axis and having a third inertia I2*a*; and
      a second blocking lever mobile (20*b*) comprising a second blocking lever element (2*b*), the second blocking lever mobile being pivoted about a fourth axis (A2*b*), inscribed within a fourth cylinder having a diameter D2*b* centered on the fourth axis and having a fourth inertia I2*b*,
   the first and second blocking lever mobiles being arranged in such a way as to cooperate, especially by gearing, with each other, the regulator device being such that:
   $D2a \times I2a < 4 \cdot 10^{-4} \times D \times I$, or $D2a \times I2a \leq 3 \cdot 10^{-4} \times D \times I$, or $D2a \times I2a \leq 2 \cdot 10^{-4} \times D \times I$; and/or
   $D2b \times I2b < 10^{-4} \times D \times I$, or $D2b \times I2b \leq 9 \cdot 10^{-5} \times D \times I$, or $D2b \times I2b \leq 8 \cdot 10^{-5} \times D \times I$; and/or
   $D3 \times I3 < 7 \cdot 10^{-5} \times D \times I$, or $D3 \times I3 \leq 6 \cdot 10^{-5} \times D \times I$, or $D3 \times I3 \leq 5 \cdot 10^{-5} \times D \times I$.
2. The device according to definition 1, wherein the axes (A3, A2*a*, A2*b*) of the escapement mobile and of the first and second blocking lever mobiles are contained within a cylinder centered on the first axis (A1) and having a diameter D', where $D' < D$, or $D' \leq 0.9 \times D$, or $D' \leq 0.85 \times D$.
3. The device according to definition 1 or 2, wherein the regulator device is such that
   $D2a < 0.4 \times D$, or $D2a \leq 0.35 \times D$, or $D2a \leq 0.3 \times D$, and/or
   $D2b < 0.35 \times D$, or $D2a \leq 0.3 \times D$, or $D2a \leq 0.25 \times D$, and/or
   $D3 < 0.4 \times D$, or $D3 \leq 0.35 \times D$, or $D3 \leq 0.3 \times D$.
4. The device according to one of definitions 1 to 3, wherein the regulator device is such that
   $D2b \times I2b \leq D2a \times I2a$.
5. The device according to one of definitions 1 to 4, wherein the regulator device is such that
   $D^5 \times f/I > 20 \cdot 10^{-2}\ m^3\ kg^{-1}\ s^{-1}$, where f is the frequency of the resonator, the frequency preferably being greater than or equal to 4 Hz.
6. The device according to one of definitions 1 to 5, wherein the regulator device is such that
   $D2b < D2a$; and/or
   $D2b' < D3$; and/or
   $D2a' < D3$,
   where:
   D2*a*' is a diameter of a cylinder on which a blocking surface (22*a*) of the first blocking lever mobile (20*a*) rests, and
   D2*b*' is a diameter of a cylinder on which a blocking surface (22*b*) of the second blocking lever mobile (20*b*) rests.
7. The device according to one of definitions 1 to 6, wherein the regulator device is such that
   $7\ mm \leq D \leq 11\ mm$.
8. The device according to one of definitions 1 to 7, wherein the device comprises:
   on the inertial element, respectively on the first blocking lever mobile, a tooth (11*a*) or a pin (11*a*) of which the flanks comprise a portion of a cylinder having a profile of an involute of a circle, and
   on the first blocking lever mobile, respectively on the inertial element, a fork (23*a*) of which the flanks comprise a portion of a cylinder having a profile of an involute of a circle.
9. The device according to one of definitions 1 to 8, wherein the first blocking lever mobile (20*a*), in particular the first blocking lever element (2*a*), is made of silicon and/or comprises cutouts (24*a*) on its plate, and/or wherein the second blocking lever mobile (20*b*), in particular the second blocking lever element (2*b*), is made of silicon and/or comprises cutouts on its plate.
10. The device according to one of definitions 1 to 9, wherein the escape wheel comprises two or three or four teeth, and/or wherein the device comprises a resonator of the balance wheel and hairspring type, the inertial element being a balance wheel.
11. The device according to one of definitions 1 to 10, wherein the tooth (11*a*) or the pin (11*a*), the first and second blocking lever elements and the escape wheel are arranged on the same level or in the same plane (P).
12. The device according to one of definitions 1 to 11, wherein it comprises an intermediate mobile (40)

arranged between a going train (50) of the movement (300) and the escapement mobile, the intermediate mobile (40) comprising a wheel (4) configured to transmit to the blocking member a first effort during the pulse phases of the escapement and to transmit to the blocking member a second effort during the disengagement phases of the escapement, the first effort being greater than the second effort.

According to the second aspect of the invention, a watch module is defined by the following definition.

13. A watch module (67) comprising a device according to one of definitions 1 to 12, wherein the first and second blocking lever mobiles and the escapement mobile are pivoted between a first movement blank (6), especially a bridge (6), and a second movement blank (7), especially a bridge (7).

According to the second aspect of the invention, a watch movement is defined by the following definition.

14. A watch movement (300) comprising a watch module according to definition 13 and/or a device according to one of definitions 1 to 12.

According to the second aspect of the invention, a timepiece is defined by the following definition.

15. A timepiece (400), especially a wristwatch, comprising a watch movement (300) according to definition 14 and/or a watch module (67) according to definition 13 and/or a device according to one of definitions 1 to 12.

Except in the case of technical or logical incompatibility, all combinations of characterizing features of the first and second aspects are envisaged.

The figures attached hereto illustrate, by way of example, an embodiment of a timepiece according to the invention.

Figure 1:
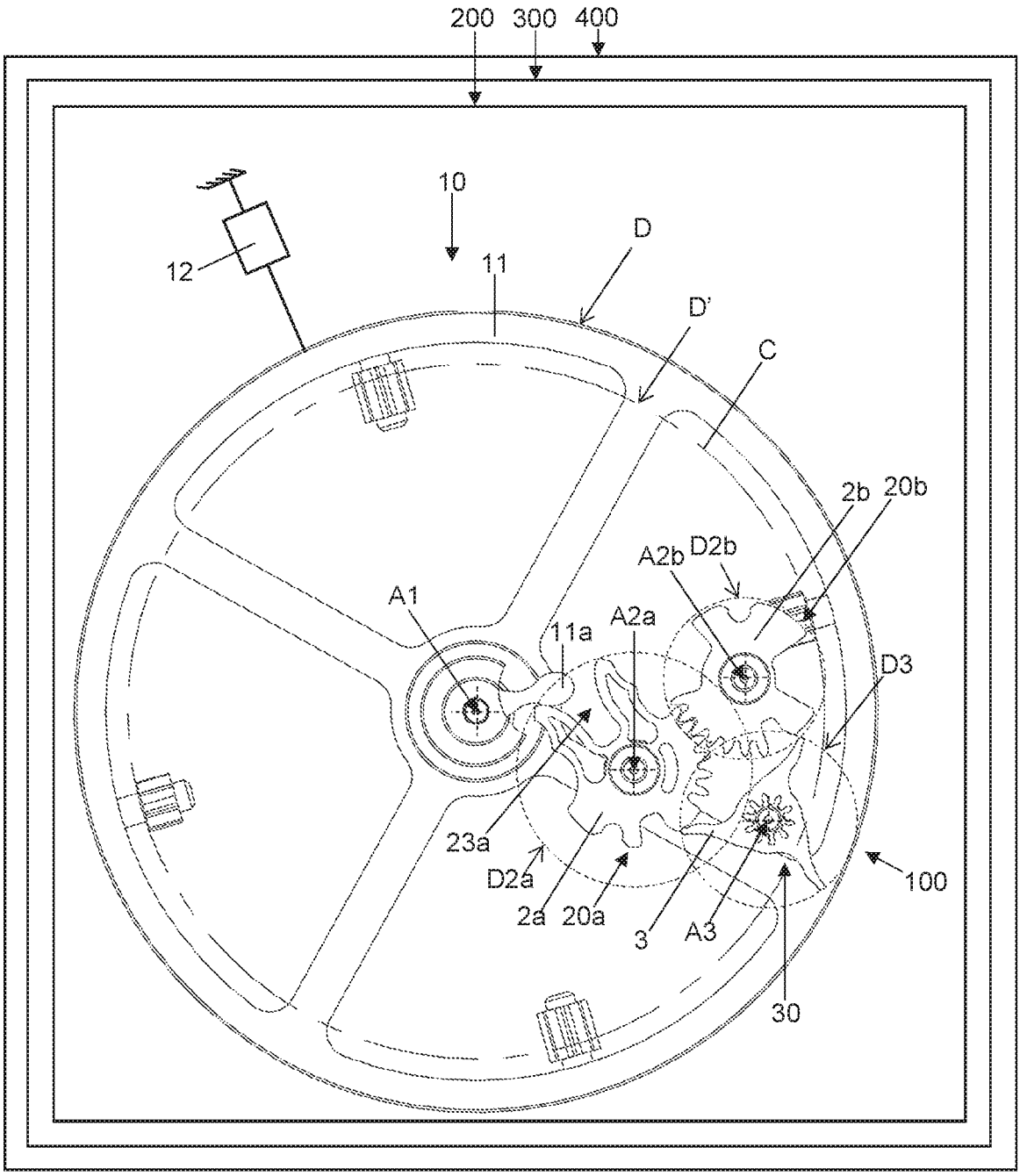
FIG. 1 is a schematic view of the embodiment of a timepiece.
Figure 2:
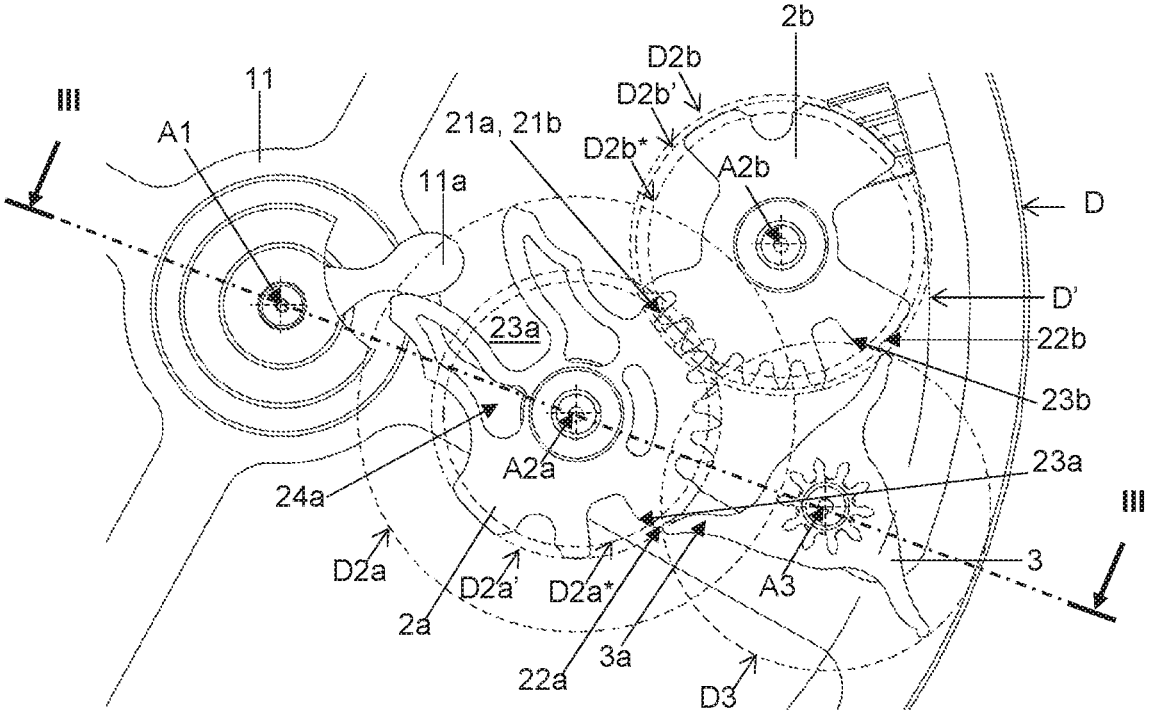
FIG. 2 is a detailed view of a part of the regulator device according to the embodiment of the timepiece.

An embodiment of a timepiece 400 is described below with reference to FIGS. 1 to 6. The timepiece is a watch, for example, in particular a wristwatch. The timepiece comprises a watch movement 300. The watch movement may be a mechanical movement, especially an automatic movement.

The movement may comprise a watch module 67.

The movement 300 or the watch module 67 comprises a regulator device 200.

The regulator device 200 comprises a resonator 10 and an escapement 100.

In particular, the regulator device 200 comprises:

an inertial element 11 of the resonator 10 pivoted about a first axis A1, the inertial element being inscribed within a first cylinder having a diameter D centered on the first axis and the resonator 10 having a first inertia I;

an escapement mobile 30 comprising an escape wheel 3 and pivoted about a second axis A3, the escapement mobile being inscribed within a second cylinder having a diameter D3 centered on the second axis and having a second inertia I3;

a blocking member 2 comprising:

a first blocking lever mobile 20*a* comprising a first blocking lever element 2*a*, the first blocking lever mobile being pivoted about a third axis A2*a*, inscribed within a third cylinder having a diameter D2*a* centered on the third axis and having a third inertia I2*a*; and a second blocking lever mobile 20*b* comprising a second blocking lever element 2*b*, the second blocking lever mobile being pivoted about a fourth axis A2*b*, inscribed within a fourth cylinder having a diameter D2*b* centered on the fourth axis and having a fourth inertia I2*b*, the first and second blocking lever mobiles, in particular the first and second blocking lever elements, being arranged in such a way as to cooperate with each other, especially by gearing, the regulator device being such that:

$D2a \times I2a < 4 \cdot 10^{-4} \times D \times I$, or $D2a \times I2a \leq 3 \cdot 10^{-4} \times D \times I$, or $D2a \times I2a \leq 2 \cdot 10^{-4} \times D \times I$; and/or $D2b \times I2b < 10^{-4} \times D \times I$, or $D2b \times I2b \leq 9 \cdot 10^{-5} \times D \times I$, or $D2b \times I2b \leq 8 \cdot 10^{-5} \times D \times I$; and/or $D3 \times I3 < 7 \cdot 10^{-5} \times D \times I$, or $D3 \times I3 \leq 6 \cdot 10^{-5} \times D \times I$, or $D3 \times I3 \leq 5 \cdot 10^{-5} \times D \times I$, and/or the axes (A3, A2*a*, A2*b*) of the escapement mobile and of the first and second blocking lever mobiles are contained within a cylinder centered on the first axis (A1) and having a diameter D', where $D' < D$, or $D' \leq 0.9 \times D$, or $D' \leq 0.85 \times D$.

Advantageously, the first blocking lever mobile 20*a*, in particular the first blocking lever element 2*a*, comprises a first toothing 21*a*, and the second blocking lever mobile 20*b*, in particular the second blocking lever element 2*b*, comprises a second toothing 21*b*. These two toothings are arranged in order to cooperate and achieve the meshing engagement of the first and second blocking lever mobiles.

The escapement mobile 30 may typically comprise a staff 31, the escape wheel 3 and an escapement pinion 32. In this case, the escape wheel 3 and/or the escapement pinion 32 may be attached to the staff 31 or may be integrally formed with the staff 31.

The first blocking lever mobile 20*a* may typically comprise a staff 21*a* to which the first blocking lever element 2*a* is attached. A dart may possibly be part of this mobile.

The second blocking lever mobile 20*b* may typically comprise a staff 21*b* to which the second blocking lever element 2*b* is attached.

The first blocking lever mobile, in particular the first blocking lever element, comprises a fork 23*a* arranged to cooperate with the balance mobile, especially arranged to cooperate with a tooth 11*a* or a pin 11*a* implemented on the balance mobile. Alternatively, the tooth or the pin could be implemented on the first blocking lever mobile, in particular on the first blocking lever element, and the fork could be implemented on the balance wheel. Thus, the pulse to the balance wheel and hairspring is implemented through the involvement of or through cooperation with the first blocking lever mobile and the balance wheel, in particular through cooperation by contact of the fork 23*a* and of the pin 11*a*.

Studies conducted by the patent holder reveal that the number teeth of the escape wheel may be minimized in such a way as to guarantee adequate security for the proper function of the escapement device 100. The number of teeth 3*a* of the escape wheel 3 is thus preferably comprised between 2 and 4. The number of teeth 3*a* of the escape wheel 3 is preferably equal to 3.

Furthermore, the minimum value of the diameter D3 of the escape wheel 3 may be determined geometrically. The teeth of the escape wheel are provided here in order to ensure a first function of transmission of torque by the escape wheel and a second function of blocking the escape wheel. The first function of transmission of torque by the escape wheel occurs during pulse phases of the escapement device, that is to say when the escape wheel 3 transmits a torque to the blocking member 2, in such a way as to give rise to and to maintain the oscillations of the resonator 10 by means of the fork 23*a* of the first blocking lever mobile 20*a* cooperating with the pin 11*a* of the balance wheel 11. During pulse phases, the extremity of a tooth 3*a* of the escape wheel 3 cooperates with one or other of the respective pulse surfaces 23*a*, 23*b* of the blocking lever mobiles 20*a*, 20*b*, in particular with the first and second blocking lever elements. The second function of blocking of the escape wheel occurs during positions of rest of the escapement device. In suchlike positions, a distal extremity of a tooth 3*a* of the escape wheel bears against a blocking surface 22*a*, 22*b* of the mobiles 20*a*, 20*b* of the blocking member 2. Preferably, a suchlike blocking surface of the blocking member is concave in order to offer security in the case of an impact or a rebound of the escape wheel. More preferably, a suchlike blocking surface 22*a*, 22*b* of the blocking member 2 is formed by two flanks subtending an angle γ comprised between 120° and 170°.

The escape wheel and the first and second blocking lever mobiles are arranged in such a way that the escape wheel, in particular its teeth, cooperate with the first and second blocking lever mobiles. In particular, the escape wheel and the first and second blocking lever mobiles are arranged in order for the teeth of the escape wheel to act by contact on specific surfaces 22*a*, 22*b*, 23*a*, 23*b* of the first and second blocking lever mobiles, in particular the first and second blocking lever elements.

At rest, the extremity of a tooth 3*a* of the escape wheel 3 cooperates with one or other of the respective blocking surfaces 22*a*, 22*b* of the blocking lever mobiles 20*a*, 20*b*, in particular the first and second blocking lever elements. During the pulse, the extremity of a tooth 3*a* of the escape wheel 3 cooperates with one or other of the respective pulse surfaces 23*a*, 23*b* of the blocking lever mobiles 20*a*, 20*b*, in particular the first and second blocking lever elements.

The operating principle of a suchlike escapement device is disclosed in patent application WO2013182243. As indicated in this document, the surfaces 22*a*, 22*b* are preferably in the form of concave surfaces, such as to optimize the accuracy in the positioning of the first and second blocking lever mobiles and of the escape wheel of the escapement device in the rest phase of the escapement device 100, and independently of any detent pins limiting the angular course of the fork 23*a*.

Detent pins are not necessary for this reason. Furthermore, a suchlike escapement device exhibits a perfectly symmetrical function and is not dependent on the adjustment of the penetrations or on the positioning of the detent pins.

It is thus still possible to benefit from suchlike advantages by optimizing the geometry of the pin 11*a* and of the fork 23*a* in such a way as to optimize the efficiency of the escapement device. To do this, the flanks of the pin and of the fork may each comprise a portion of a cylinder of which the director is an involute of a circle. A suchlike conformation achieves quite effective levels of efficiency by minimizing the influence of the lift angle of the balance wheel on its isochronism efficiency.

Good levels of efficiency of the escapement device may thus allow an increase in the lift angle of the balance wheel. It is thus still possible to reduce the clearance between the axis A1 of the balance wheel and hairspring and the axis A2*a* of the first blocking lever mobile 2*a*, and thus the total diameter D2*a* of the first blocking lever mobile 2*a*.

Furthermore, it is likewise possible to propose a first blocking lever mobile 20*a* without a dart considering its operating precision. It is thus still possible to reduce the inertia I2*a* of the first blocking lever mobile 20*a*. This inertia may be minimized in particular by the judicious choice of a material of low density, such as silicon for example, in order to produce the first mobile or the first blocking lever element, as well as by one or a plurality of cutouts 24*a* executed on the plate of the first blocking lever element 2*a*.

It is likewise possible to minimize the total diameter D2*b* and the inertia I2*b* of the second blocking lever mobile 20*b*. Advantageously, the total diameter D2*b* may be substantially equal to the head diameter D2*b*' of the toothing 21*b*, with a blocking surface 22*b* disposed substantially at the level of the diameter D2*b*'. Additionally, the inertia I2*b* of the second blocking lever mobile 20*b* may be minimized in particular by the judicious choice of a material of low density, such as silicon for example, in order to produce the second mobile or the second blocking lever element, as well as by one or a plurality of cutouts, not illustrated in the figures, executed on the plate of the second blocking lever element 2*b*.

Preferably, the pitch circle diameters D2*a, D2*b of the toothings 21*a*, 21*b* of the first and second mobiles 20*a*, 20*b* are equal in order to minimize the differences in inertia between these two mobiles.

On the basis of the definition of the blocking lever mobiles, it is also possible to design an escapement mobile 30 for the escapement 3, of which the total diameter D3 and the inertia I3 are minimized.

Preferably, the axes A3, A2*a*, A2*b* of the escapement mobile and of the first and second blocking lever mobiles are contained within a cylinder centered on the first axis A1 and having a diameter D', where D'<D, or D'≤0.9×D, or D'≤0.85×D.

More preferably, the regulator device is such that

D2*a*<0.4×D, or D2*a*≤0.35×D, or D2*a*≤0.3×D, and/or

D2*b*<0.35×D, or D2*a*≤0.3×D, or D2*a*≤0.25×D, and/or

D3<0.4×D, or D3≤0.35×D, or D3≤0.3×D.

Preferably, the regulator device is such that

D2*b*×I2*b*≤D2*a*×I2*a*.

More specifically, the regulator device is such that

D2*b*<D2*a*

Preferably, the regulator device is such that $D^5 \times f/I > 20 \cdot 10^{-2}\ m^3\ kg^{-1}\ s^{-1}$, where f is the frequency of the resonator, the frequency being preferably greater than or equal to 4 Hz.

Studies undertaken by the patent holder reveal that optimization of the conduct of the escape wheel leads to a multiplicative wheel train between the escapement mobile 30 and the first and second blocking lever mobiles 20*a*, 20*b*. As a result, given that the blocking surfaces 22*a*, 22*b* provided in order to cooperate with the distal extremities of the teeth 3*a* may advantageously be disposed substantially at the level of the diameters D2*a*', D2*b*' with respect to the respective axes A2*a*, A2*b*, the following conditions are preferably observed:

D2*b*'<D3; and/or

D2*a*'<D3, where:

D2*a*' is a diameter, relative to the axis A2*a*, of a cylinder on which the blocking surface 22*a* of the first blocking lever mobile 20*a* rests, and D2*b*' is a diameter, relative to the axis A2*b*, of a cylinder on which the blocking surface 22*b* of the second blocking lever mobile 20*b* rests.

The regulator device is preferably such that 7 mm≤D≤11 mm. A suchlike condition has the added advantage of minimizing the occupied space in the plane of the first and second blocking lever mobiles and of the escapement mobile 30 by confining them under the balance wheel and hairspring (viewed in the axis of the balance wheel). This condition is advantageous for movements of which the total diameter D* may be comprised between 18 mm and 35 mm, and is particularly advantageous for movements of "ladies'" size, of which the total diameter D* may be comprised between 18 mm and 22 mm.

Figure 3:
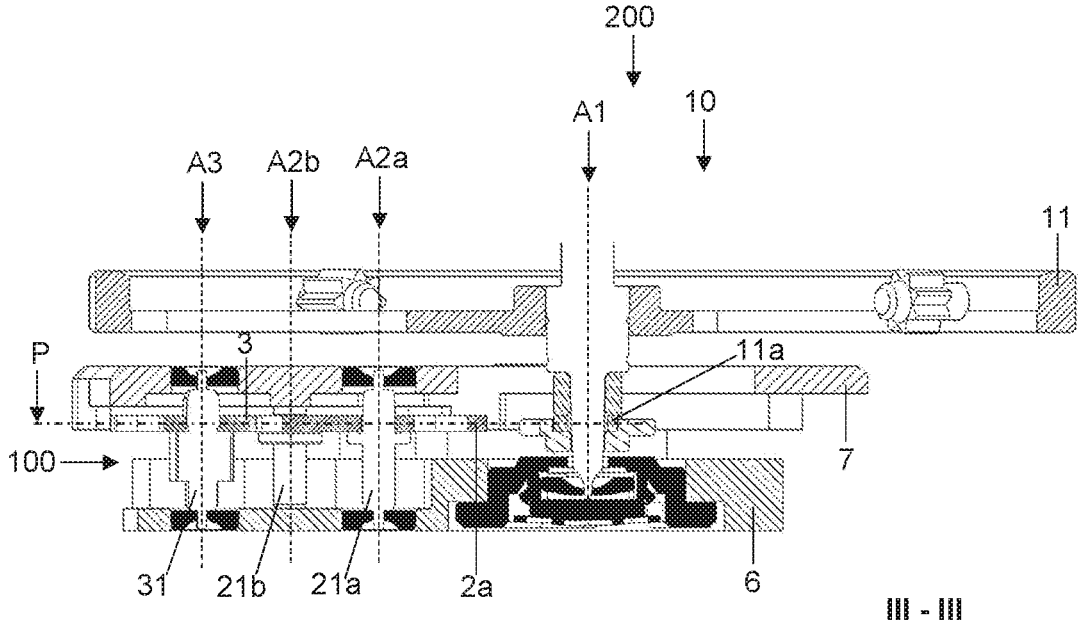
FIG. 3 is a view in cross section, according to the plane III-Ill in FIG. 2, of the regulator device according to the embodiment of the timepiece.

The tooth 11*a* or the pin 11*a*, the first and second blocking lever elements 2*a*, 2*b* and the escape wheel 3 are preferably arranged on the same level or in the same plane P, as illustrated in FIG. 3. Thus, the elements 11*a*, 2*a*, 2*b*, 3 may cooperate in one and the same plane P, that is to say there exists a plane P perpendicular or substantially perpendicular to the axes A1, A2*a*, A2*b*, A3 and passing through the zones of contact between:

- the pin and the fork;
- the first blocking lever mobile, in particular the first blocking lever element, and the second blocking lever mobile, in particular the second blocking lever element;
- the first blocking lever mobile, in particular the first blocking lever element, and the escape wheel;
- the second blocking lever mobile, in particular the second blocking lever element, and the escape wheel.

A suchlike conformation is used to minimize the thickness of the regulator device, especially to minimize the thickness of the escapement device, while implementing component parts 11*a*, 2*a*, 2*b*, 2*c* which are planar and of which the fabrication is facilitated.

Figure 4:
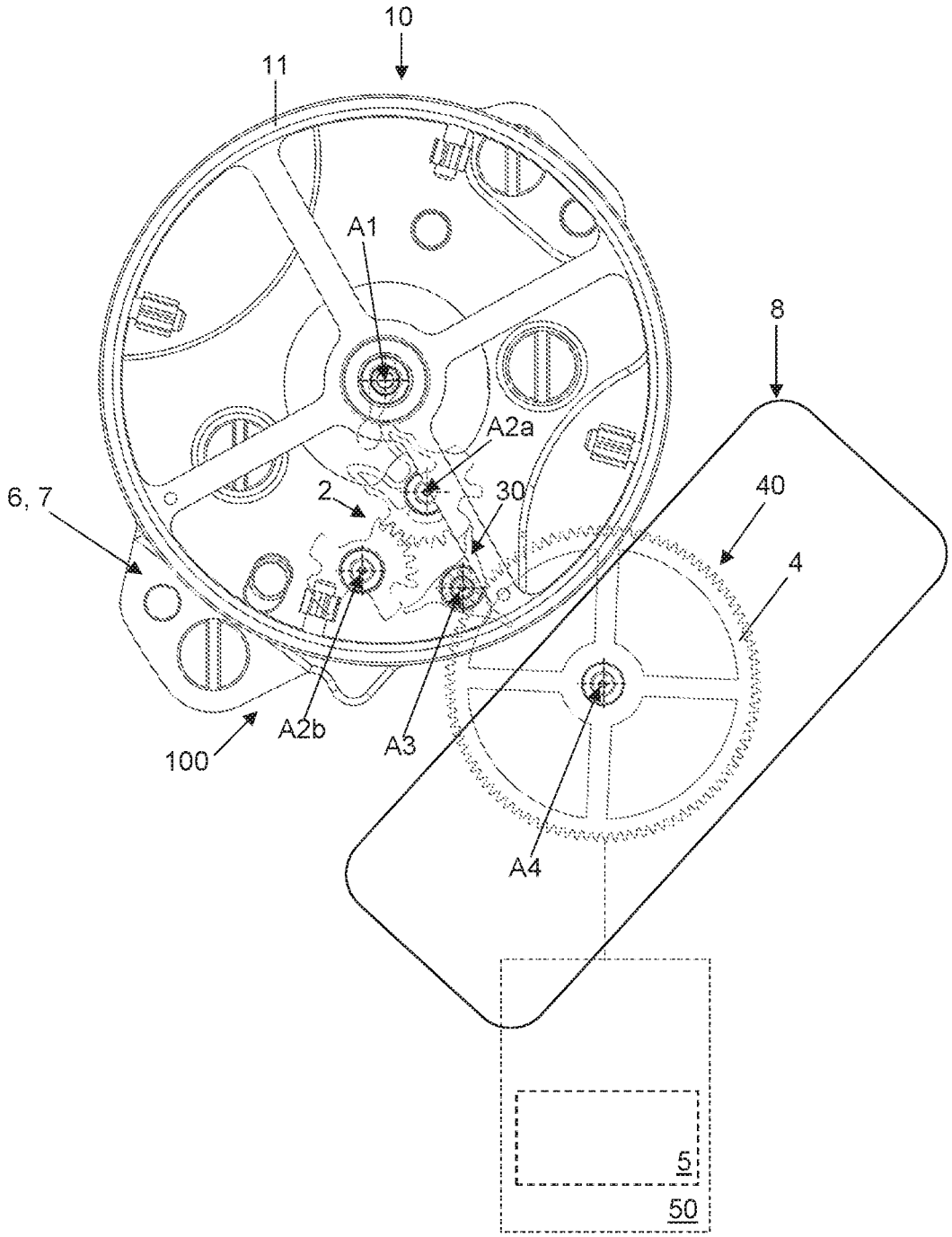
FIG. 4 is a schematic view of a variant of the embodiment of the timepiece.

A suchlike conformation is thus used to free up space in the plane of the movement. It is used especially to free up space in such a way as to pivot an intermediate mobile 40 constituting an interface between a going train 50 of the movement 300, especially between a drive component 5 and the escapement device 100, as illustrated in FIG. 4. This intermediate mobile 40 advantageously comprises a wheel 4, which may be configured to transmit a first effort during the pulse phases of the escapement device and a second effort during the phases of disengagement of the escapement device, the first effort being substantially greater than the second effort of the blocking member 2. The axis of rotation A4 of the mobile 40 is or is not contained within the cylinder C having a diameter D'.

The module 67 advantageously comprises a first movement blank 6, especially a bridge 6, and a second movement blank 7, especially a bridge 7. More advantageously, the first and second blocking lever mobiles and the escapement mobile are pivoted between the first movement blank 6 and a second movement blank 7. The second movement blank 7 may be planar, for example. These first and second movement blanks may, of course, include means of pivoting such as bearings, especially pivot jewels.

Thus, in the embodiment in FIG. 4, the three mobiles 20*a*, 20*b*, and 30 are pivoted by means of two movement blanks 6, 7, and the mobile 40 is pivoted by means of a gear train bridge 8 pivoting at least partially the going train of the movement.

Figure 5:
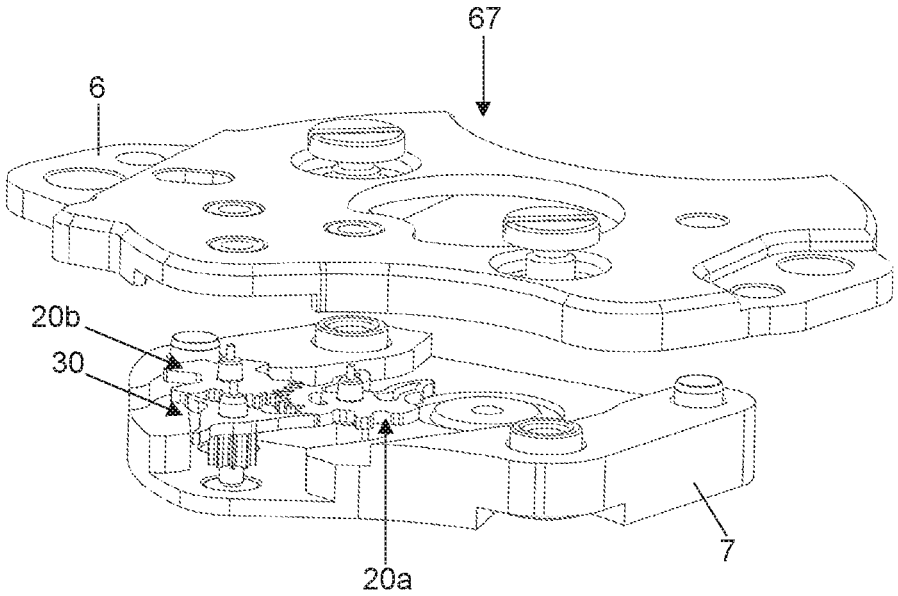
FIGS. 5 and 6 are partial, exploded and perspective views of an embodiment of a regulator device of the timepiece.
Figure 6:
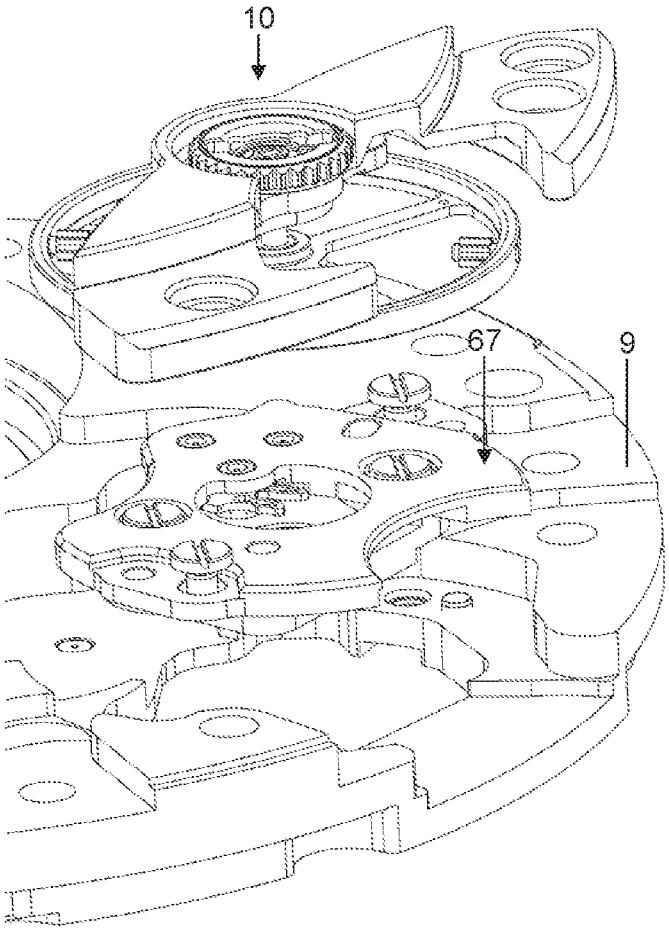

The first and second movement blanks 6, 7 and at least the mobiles 20*a*, 20*b*, 30 preferably constitute a module 67 capable of attachment to a plate 9 of the movement 300, as illustrated in FIGS. 5 and 6. Thus, at least the mobiles 20*a*, 20*b*, 30 may be assembled independently of the other parts of the movement. A suchlike solution is particularly advantageous in the case in which the mobiles 20*a*, 20*b*, 30 are intended to implement, at least partially, an escapement device designed to equip different movements. The module 67 may thus be assembled, inspected and lubricated ahead of the final assembly of the component parts of the movement. A suchlike solution is particularly advantageous when the elements 2*a*, 2*b*, 3 are made from a fragile material such as silicon. FIG. 4 depicts a suchlike module integrating the mobiles 20*a*, 20*b*, 30, the mobile 40 being pivoted by the gear train bridge of 8 illustrated schematically in FIG. 4.

Alternatively, the watch movement 300 comprises a plate on which the first and second blocking lever mobiles and the escapement mobile are pivoted directly. In particular, these different mobiles may be pivoted between the plate and a bridge.

In the different variant embodiments, the resonator may be of the balance wheel and hairspring type, that is to say comprising a balance wheel 11 and a hairspring 12. In the case in which the inertial element is a balance wheel, the diameter D may be the diameter of the external circumference of the balance wheel felloe. If this felloe exhibits protuberances, such as means of adjustment, for example, the diameter D concerned will be an equivalent external diameter, obtained by considering a virtual balance wheel having the same resonator inertia I and having the same felloe section, but without the protuberances on the felloe, and which generates the same aerodynamic friction values.

In the different variant embodiments, the resonator may alternatively comprise a monolithic structure including an inertial element of which the oscillations are maintained by flexible blades capable of playing the part of a pivoting device of the resonator. In this case, the diameter D relates to the external diameter of the inertial element. If this inertial element exhibits protuberances at the level of its external periphery, such as means of adjustment, for example, the diameter D concerned will be an equivalent external diameter, obtained by considering a virtual inertial element having the same resonator inertia I and having a geometry of the inertial element comparable to that of the reference inertial element (obtained by homothety), but without the protuberances on the external periphery, and which generates the same aerodynamic friction values.

In the different variant embodiments, the escapement may be an indirect-pulse escapement, especially a double indirect-pulse escapement, and/or may be tangentially driven.

In an advantageous variant, the escapement device, or the regulator device, may be provided on a module 67, which may be attached directly to a movement or to a framework in order to constitute a movement.

According to the second aspect of the invention, an embodiment of a regulator device comprises:

- an inertial element 11 of a resonator 10 pivoted about a first axis A1, the inertial element being inscribed within a first cylinder having a diameter D centered on the first axis, and the resonator 10 having a first inertia I;
- an escapement mobile 30 comprising an escape wheel 3 and pivoted about a second axis A3, the escapement mobile being inscribed within a second cylinder having a diameter D3 centered on the second axis and having a second inertia I3;
- a blocking member 2 comprising:
  - a first blocking lever mobile 20*a* comprising a first blocking lever element 2*a*, the first blocking lever mobile being pivoted about a third axis A2*a*, inscribed within a third cylinder having a diameter D2*a* centered on the third axis and having a third inertia I2*a*; and a second blocking lever mobile 20*b* comprising a second blocking lever element 2*b*, the second blocking lever mobile being pivoted about a fourth axis A2*b*, inscribed within a fourth cylinder having a diameter D2*b* centered on the fourth axis and having a fourth inertia I2*b*, the first and second blocking lever mobiles, in particular the first and second blocking lever elements, being arranged in such a way as to cooperate with each other, especially by gearing, the regulator device being such that:

$D2a \times I2a < 4 \cdot 10^{-4} \times D \times I$, or $D2a \times I2a \leq 3 \cdot 10^{-4} \times D \times I$, or $D2a \times I2a \leq 2 \cdot 10^{-4} \times D \times I$; and/or $D2b \times I2b < 10^{-4} \times D \times I$, or $D2b \times I2b \leq 9 \cdot 10^{-5} \times D \times I$, or $D2b \times I2b \leq 8 \cdot 10^{-5} \times D \times I$; and/or $D3 \times I3 < 7 \cdot 10^{-5} \times D \times I$, or $D3 \times I3 \leq 6 \cdot 10^{-5} \times D \times I$, or $D3 \times I3 \leq 5 \cdot 10^{-5} \times D \times I$.

The solutions described previously are advantageous because they implement efficient escapement devices exhibiting a high level of efficiency, while minimizing their impact on the isochronism of the resonator. They allow a reliable and trouble-free function to be achieved under all conditions of use, especially in the event of impacts. In order to respond to these objectives, the tangentially driven escapement device is advantageous because it requires little energy, the friction being minimized, as far as possible, between the escape wheel and the blocking member thanks to transmissions of the geared type. As indicated within patent application WO2017109004, the intensity of the effort required for the disengagement of a suchlike escapement device may be substantially smaller than the intensity of the effort required for pulsing this same escapement device, the advantage of which is to minimize significantly its impact on the isochronism of the resonator. Furthermore, a suchlike escapement device comprises a blocking member containing two blocking lever mobiles linked cinematically to each other of a kind such that, if an angular impact acts in one direction on a first mobile, the latter is limited in its displacement by the second mobile. By its configuration, a suchlike escapement device thus exhibits a reliable and trouble-free function under all operating conditions, especially in the event of impacts. It is thus still possible to minimize the inertia of the elements involved in a suchlike escapement device, in such a way as to optimize its efficiency and to minimize its influence on the isochronism of an efficient balance wheel and hairspring.

Throughout this document, the expression "inertia of the resonator" means the inertia of the assembly of the mobile elements of the resonator or the sum of the inertia of the mobile elements of the resonator. In the case of a resonator of the balance wheel and hairspring type, the assembly of the mobile elements comprises especially the balance wheel 11, the hairspring 12 and the mobile pivoting means, such as a balance wheel staff, for example.

Of course, throughout this document, the expression "inertia of an element" means the inertia of the element about its rotation axis during operation. The first inertial is the inertia of the inertial element 11 about the first axis. The second inertia I3 is the inertia of the escapement mobile 30 about the second axis A3. The third inertia I2*a* is the inertia of the first blocking lever mobile 20*a* about the third axis A2*a*. The fourth inertia I2*b* is the inertia of the second blocking lever mobile 20*b* about the fourth axis A2*b*.

Throughout this document, the expression "mobile" means in particular an assembly pivoted about an axis. The assembly may be monobloc or constituted by a plurality of parts that are attached to one another or in an embedded connection.

Of course, throughout this document, the expression "an element inscribed within a cylinder having a diameter D centered on an axis" means that the diameter D is the smallest diameter centered on the axis such that the element is included in the cylinder.

The invention claimed is:

1. A regulator device for a watch movement, comprising:

an inertial element of a resonator pivoted about a first axis, the inertial element being inscribed within a first cylinder having a diameter D centered on the first axis and the resonator having a first inertia I;

an escapement mobile comprising an escape wheel and pivoted about a second axis, the escapement mobile being inscribed within a second cylinder having a diameter D3 centered on the second axis and having a second inertia I3;

a blocking member comprising:

a first blocking lever mobile comprising a first blocking lever element, the first blocking lever mobile being pivoted about a third axis, inscribed within a third cylinder having a diameter D2*a* centered on the third axis and having a third inertia I2*a*; and a second blocking lever mobile comprising a second blocking lever element, the second blocking lever mobile being pivoted about a fourth axis, inscribed within a fourth cylinder having a diameter D2*b* centered on the fourth axis and having a fourth inertia I2*b*, the first and second blocking lever mobiles being arranged in such a way as to cooperate with each other, the axes of the escapement mobile and of the first and second blocking lever mobiles being contained within a cylinder centered on the first axis and having a diameter D', where D'<D.

2. The device according to claim 1, wherein the regulator device is configured so that $D2a < 0.4 \times D$; and/or $D2b < 0.35 \times D$; and/or $D3 < 0.4 \times D$.

3. The device according to claim 2, wherein the regulator device is configured so that $D2a < 0.3 \times D$; and/or $D2b < 0.25 \times D$; and/or $D3 < 0.3 \times D$.

4. The device according to claim 1, wherein the regulator device is configured so that $D2b \times I2b < D2a \times I2a$.

5. The device according to claim 1, wherein the regulator device is configured so that $D^5 \times f/I > 20 \cdot 10^{-2}\ m^3\ kg^{-1} s^{-1}$, where f is a frequency of the resonator.

6. The device according to claim 5, wherein the frequency is greater than or equal to 4 Hz.

7. The device according to claim 1, wherein the regulator device is configured so that $D2b < D2a$; and/or $D2b' < D3$; and/or $D2a' < D3$, where:

D2*a*' is a diameter of a cylinder on which a blocking surface of the first blocking lever mobile rests, and D2*b*' is a diameter of a cylinder on which a blocking surface of the second blocking lever mobile rests.

8. The device according to claim 1, wherein the regulator device is configured so that 7 mm≤D≤11 mm.

9. The device according to claim 1, wherein the device comprises:

on the inertial element, respectively on the first blocking lever mobile, a tooth or a pin, wherein flanks of the tooth or pin comprise a portion of cylinder having a profile of an involute of a circle, and on the first blocking lever mobile, respectively on the inertial element, a fork, wherein flanks of the fork comprise a portion of cylinder having a profile of an involute of a circle.

10. The device according to claim 9, wherein the tooth or the pin, the first and second blocking lever elements and the escape wheel are arranged on the same level or in the same plane.

11. The device according to claim 1, wherein at least one of the first and second blocking lever mobiles is made of silicon and/or comprises cutouts on a plate thereof.

12. The device according to claim 1, wherein the escape wheel comprises two or three or four teeth.

13. The device according to claim 1, wherein the device comprises the resonator and the resonator comprises a balance wheel and hairspring, the inertial element being the balance wheel.

14. The device according to claim 1, wherein the device comprises an intermediate mobile arranged between a going train of the movement and the escapement mobile, the intermediate mobile comprising a wheel configured to transmit to the blocking member a first effort during pulse phases of the escapement and to transmit to the blocking member a second effort during phases of disengagement of the escapement, the first effort being greater than the second effort.

15. A watch module comprising a device according to claim 1, wherein the first and second blocking lever mobiles and the escapement mobile are pivoted between a first movement blank and a second movement blank.

16. The watch module according to claim 15, wherein the first and second movement blanks are bridges.

17. A watch movement comprising the watch module according to claim 15.

18. A watch movement comprising the device according to claim 1.

19. A timepiece comprising the watch movement according to claim 18.

20. The device according to claim 1, wherein D'≤0.85×D.

21. The device according to claim 1, wherein the first and second blocking lever mobiles cooperate by gearing.

* * * * *